US009190712B2

(12) United States Patent
Hu et al.

(10) Patent No.: US 9,190,712 B2
(45) Date of Patent: Nov. 17, 2015

(54) TUNABLE ANTENNA SYSTEM

(75) Inventors: Hongfei Hu, Santa Clara, CA (US); Mattia Pascolini, Campbell, CA (US); Robert W. Schlub, Cupertino, CA (US); Matthew A. Mow, Los Altos, CA (US); Nanbo Jin, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 265 days.

(21) Appl. No.: 13/366,142

(22) Filed: Feb. 3, 2012

(65) Prior Publication Data

US 2013/0201067 A1 Aug. 8, 2013

(51) Int. Cl.

| | |
|---|---|
| ***H01Q 21/30*** | (2006.01) |
| ***H01Q 1/50*** | (2006.01) |
| ***H01Q 1/24*** | (2006.01) |
| ***H01Q 9/04*** | (2006.01) |
| ***H01Q 9/42*** | (2006.01) |
| ***H01Q 5/321*** | (2015.01) |
| ***H01Q 5/328*** | (2015.01) |

(52) U.S. Cl.

CPC ..... *H01Q 1/243* (2013.01); *H01Q 5/321* (2015.01); *H01Q 5/328* (2015.01); *H01Q 9/0421* (2013.01); *H01Q 9/42* (2013.01)

(58) Field of Classification Search

CPC ..... H01Q 5/321

See application file for complete search history.

(56) References Cited

U.S. PATENT DOCUMENTS

| | | | |
|---|---|---|---|
| 2,324,462 | A | 7/1943 | Leeds et al. |
| 3,394,373 | A | 7/1968 | Makrancy |
| 3,736,591 | A | 5/1973 | Rennels et al. |
| 4,123,756 | A | 10/1978 | Nagata et al. |
| 4,449,108 | A | 5/1984 | Endo et al. |
| 4,518,965 | A | 5/1985 | Hidaka |
| 4,617,571 | A | 10/1986 | Choquer et al. |
| 4,893,131 | A | 1/1990 | Smith et al. |

(Continued)

FOREIGN PATENT DOCUMENTS

| | | |
|---|---|---|
| CN | 1745500 | 3/2006 |
| CN | 101002361 | 7/2007 |

(Continued)

OTHER PUBLICATIONS

.Caballero et al., U.S. Appl. No. 12/941,010, filed Nov. 5, 2010.

(Continued)

*Primary Examiner* — Hoang V Nguyen

*Assistant Examiner* — Michael Bouizza

(74) *Attorney, Agent, or Firm* — Treyz Law Group; G. Victor Treyz; Michael H. Lyons

(57) ABSTRACT

An electronic device antenna may be provided with an antenna ground. An antenna resonating element may have a first end that is coupled to the ground using an inductor and may have a second end that is coupled to a peripheral conductive housing member in an electronic device. The peripheral conductive housing member may have a portion that is connected to the ground and may have a portion that is separated from the ground by a gap. The gap may be bridged by an inductor that couples the second end of the antenna resonating element to the antenna ground. The inductor may be bridged by a switch. A tunable circuit such as a capacitor bridged by a switch may be interposed in the antenna resonating element. The switches that bridge the gap and the capacitor may be used in tuning the antenna.

23 Claims, 11 Drawing Sheets

(56) References Cited

U.S. PATENT DOCUMENTS

| | | | | |
|---|---|---|---|---|
| 5,381,387 | A | 1/1995 | Blonder et al. | |
| 5,465,098 | A | 11/1995 | Fujisawa et al. | |
| 5,627,552 | A | 5/1997 | Farrar et al. | |
| 5,812,066 | A | 9/1998 | Terk et al. | |
| 6,014,113 | A | 1/2000 | Orchard et al. | |
| 6,255,994 | B1 | 7/2001 | Saito | |
| 6,496,083 | B1 * | 12/2002 | Kushitani et al. | 333/103 |
| 6,606,063 | B1 | 8/2003 | Merenda | |
| 6,812,898 | B2 | 11/2004 | Doub et al. | |
| 6,856,294 | B2 | 2/2005 | Kadambi et al. | |
| 7,084,814 | B2 | 8/2006 | Chen et al. | |
| 7,132,987 | B1 | 11/2006 | Olsson et al. | |
| 7,167,090 | B1 | 1/2007 | Mandal et al. | |
| 7,215,283 | B2 | 5/2007 | Boyle | |
| 7,250,910 | B2 | 7/2007 | Yoshikawa et al. | |
| 7,260,424 | B2 | 8/2007 | Schmidt | |
| 7,348,928 | B2 | 3/2008 | Ma et al. | |
| 7,400,302 | B2 | 7/2008 | Winter | |
| 7,405,697 | B2 * | 7/2008 | Ying | 343/702 |
| 7,408,517 | B1 | 8/2008 | Poilasne et al. | |
| 7,482,897 | B2 | 1/2009 | Puoskari et al. | |
| 7,612,725 | B2 | 11/2009 | Hill et al. | |
| 7,671,693 | B2 | 3/2010 | Brobston et al. | |
| 7,671,804 | B2 | 3/2010 | Zhang et al. | |
| 7,876,274 | B2 | 1/2011 | Hobson et al. | |
| 7,889,139 | B2 | 2/2011 | Hobson et al. | |
| 8,076,991 | B2 | 12/2011 | Carmel et al. | |
| 8,169,373 | B2 | 5/2012 | Schlub et al. | |
| 8,227,700 | B2 | 7/2012 | Kim | |
| 8,270,914 | B2 | 9/2012 | Pascolini et al. | |
| 2003/0117900 | A1 | 6/2003 | Fujisawa et al. | |
| 2004/0008146 | A1 | 1/2004 | Ikegaya et al. | |
| 2004/0041734 | A1 | 3/2004 | Shiotsu et al. | |
| 2004/0056808 | A1 | 3/2004 | Jenwatanavet | |
| 2004/0227678 | A1 | 11/2004 | Sievenpiper | |
| 2004/0257283 | A1 | 12/2004 | Asano et al. | |
| 2004/0263411 | A1 | 12/2004 | Fabrega-Sanchez et al. | |
| 2005/0085204 | A1 | 4/2005 | Poilanse et al. | |
| 2006/0055606 | A1 | 3/2006 | Boyle | |
| 2006/0097941 | A1 | 5/2006 | Bettren et al. | |
| 2006/0114159 | A1 | 6/2006 | Yoshikawa et al. | |
| 2006/0125703 | A1 | 6/2006 | Ma et al. | |
| 2007/0146218 | A1 | 6/2007 | Turner et al. | |
| 2007/0149145 | A1 | 6/2007 | Chang et al. | |
| 2007/0200766 | A1 | 8/2007 | McKinzie et al. | |
| 2007/0222697 | A1 | 9/2007 | Caimi et al. | |
| 2007/0224948 | A1 | 9/2007 | Hartenstein et al. | |
| 2007/0229376 | A1 | 10/2007 | Desclos et al. | |
| 2008/0024163 | A1 | 1/2008 | Marui | |
| 2008/0081581 | A1 | 4/2008 | Rofougaran | |
| 2008/0100514 | A1 | 5/2008 | Abdul-Gaffoor et al. | |
| 2008/0143613 | A1 | 6/2008 | Iwai et al. | |
| 2008/0150811 | A1 | 6/2008 | Honda et al. | |
| 2008/0218291 | A1 | 9/2008 | Zhu et al. | |
| 2008/0266199 | A1 | 10/2008 | Milosavljevic et al. | |
| 2008/0305749 | A1 | 12/2008 | Ben-Bassat | |
| 2008/0316115 | A1 | 12/2008 | Hill et al. | |
| 2009/0002239 | A1 | 1/2009 | Mao et al. | |
| 2009/0051604 | A1 | 2/2009 | Zhang et al. | |
| 2009/0081963 | A1 | 3/2009 | Boren | |
| 2009/0115674 | A1 * | 5/2009 | Fujieda et al. | 343/745 |
| 2009/0128428 | A1 | 5/2009 | Ishizuka et al. | |
| 2009/0153412 | A1 | 6/2009 | Chiang et al. | |
| 2009/0179811 | A1 | 7/2009 | Chou | |
| 2009/0180403 | A1 | 7/2009 | Tudosoiu | |
| 2009/0185325 | A1 | 7/2009 | Park et al. | |
| 2009/0256758 | A1 | 10/2009 | Schlub et al. | |
| 2009/0256759 | A1 | 10/2009 | Hill et al. | |
| 2009/0305738 | A1 | 12/2009 | Boyle | |
| 2010/0022203 | A1 | 1/2010 | Bonnet et al. | |
| 2010/0026459 | A1 | 2/2010 | Seppa | |
| 2010/0053002 | A1 | 3/2010 | Wojack et al. | |
| 2010/0060421 | A1 | 3/2010 | Chang et al. | |
| 2010/0060529 | A1 | 3/2010 | Schlub et al. | |
| 2010/0109968 | A1 | 5/2010 | Suzuki et al. | |
| 2010/0123632 | A1 | 5/2010 | Hill et al. | |
| 2010/0149052 | A1 | 6/2010 | Nishio et al. | |
| 2010/0214180 | A1 | 8/2010 | Krogerus | |
| 2010/0231481 | A1 | 9/2010 | Chiang et al. | |
| 2010/0271271 | A1 | 10/2010 | Wu | |
| 2010/0295737 | A1 | 11/2010 | Milosavljevic et al. | |
| 2010/0302123 | A1 | 12/2010 | Knudsen et al. | |
| 2010/0321255 | A1 * | 12/2010 | Kough et al. | 343/702 |
| 2011/0006953 | A1 | 1/2011 | Chiang et al. | |
| 2011/0063779 | A1 | 3/2011 | Ochi et al. | |
| 2011/0136447 | A1 | 6/2011 | Pascolini et al. | |
| 2011/0183633 | A1 | 7/2011 | Ohba et al. | |
| 2011/0187478 | A1 | 8/2011 | Link et al. | |
| 2011/0206165 | A1 | 8/2011 | Schwab et al. | |
| 2011/0241949 | A1 | 10/2011 | Nickel et al. | |
| 2011/0260942 | A1 | 10/2011 | Hashizume | |
| 2012/0001815 | A1 | 1/2012 | Wong et al. | |
| 2012/0009983 | A1 | 1/2012 | Mow et al. | |
| 2012/0162033 | A1 | 6/2012 | Togashi | |
| 2012/0227347 | A1 | 9/2012 | Jin et al. | |
| 2012/0229347 | A1 | 9/2012 | Jin et al. | |
| 2012/0231750 | A1 | 9/2012 | Jin et al. | |
| 2013/0169490 | A1 | 7/2013 | Pascolini et al. | |
| 2013/0214979 | A1 | 8/2013 | McMillin et al. | |

FOREIGN PATENT DOCUMENTS

| | | | |
|---|---|---|---|
| CN | 101019273 | | 8/2007 |
| CN | 101682119 | | 3/2010 |
| CN | 201533015 | | 7/2010 |
| CN | 101814649 | | 8/2010 |
| CN | 101911379 | | 12/2010 |
| DE | 20314836 | | 11/2003 |
| DE | 10353104 | | 6/2005 |
| EP | 0741433 | | 11/1996 |
| EP | 1315238 | | 5/2003 |
| EP | 1753082 | | 4/2005 |
| EP | 1553658 | | 7/2005 |
| EP | 1557903 | | 7/2005 |
| EP | 1594188 | | 11/2005 |
| EP | 1686651 | A2 | 8/2006 |
| EP | 2161785 | | 3/2010 |
| EP | 2405534 | | 1/2012 |
| GB | 921950 | | 3/1963 |
| GB | 0944039 | | 12/1963 |
| GB | 2384367 | | 7/2003 |
| GB | 2463536 | | 3/2010 |
| JP | 09-093029 | | 4/1997 |
| JP | 09-307344 | | 11/1997 |
| JP | 2001136019 | | 5/2001 |
| JP | 200448119 | | 2/2004 |
| JP | 2006180077 | | 7/2006 |
| JP | 2009049455 | | 3/2009 |
| JP | 2010147636 | | 7/2010 |
| JP | 2010536246 | | 11/2010 |
| KR | 2004108759 | | 12/2004 |
| KR | 10-2012-0004338 | | 1/2012 |
| WO | 8905530 | | 6/1989 |
| WO | 2004008634 | | 1/2004 |
| WO | 2006031170 | | 3/2006 |
| WO | 2006114771 | | 11/2006 |
| WO | 2007039667 | | 4/2007 |
| WO | 2008010149 | | 1/2008 |
| WO | 2009002575 | | 12/2008 |
| WO | 2009091323 | | 7/2009 |
| WO | 2010032066 | | 3/2010 |
| WO | 2010137061 | | 12/2010 |
| WO | 2012006152 | | 1/2012 |

OTHER PUBLICATIONS

Caballero et al., U.S. Appl. No. 12/941,011, filed Nov. 5, 2010.
Jin et al., U.S. Appl. No. 13/041,934, filed Mar. 7, 2011.
Jin et al., U.S. Appl. No. 13/041,905, filed Mar. 7, 2011.
Jarvis et al., U.S. Appl. No. 12/823,929, filed Jun. 25, 2010.
Schlub et al., U.S. Appl. No. 12/759,243, filed Apr. 13, 2010.
Nickel et al., U.S. Appl. No. 12/752,966, filed Apr. 1, 2010.

(56) References Cited

OTHER PUBLICATIONS

Lee et al. "A Compact and Low-Profile Tunable Loop Antenna Integrated With Inductors", IEEE Antennas and Wireless Propagation Letters, vol. 7, 2008 pp. 621-624.
Pascolini et al., U.S. Appl. No. 12/630,756, filed Dec. 3, 2009.
Mow et al., U.S. Appl. No. 12/831,180, filed Jul. 6, 2010.
Menzel et al., "A Microstrip Patch Antenna with Coplanar Feed Line" IEEE Microwave and Guided Wave Letters, vol. 1, No. 11, Nov. 1991, pp. 340-342.
Terada et al., "Circularly Polarized Tunable Microstrip Patch Antenna Using an Adjustable Air Gap", Proceedings of ISAP2005, Seoul, Korea pp. 977-980.

* cited by examiner

TUNABLE ANTENNA SYSTEM

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

Electronic devices may be provided that contain wireless communications circuitry. The wireless communications circuitry may include radio-frequency transceiver circuitry and antenna structures. The antenna structures may form one or more antennas.

An electronic device antenna may be provided with an antenna ground. An antenna resonating element may have an arm with a first end that is coupled to the ground using an inductor and a second end that is coupled to a peripheral conductive housing member in an electronic device. The peripheral conductive housing member may have a portion that is connected to the ground and may have a portion that is separated from the ground by a gap. The gap may be bridged by an inductor that couples the second end of the antenna resonating element to the antenna ground. The inductor may be bridged by a switch. A tunable circuit such as a capacitor bridged by a switch may be interposed in the antenna resonating element arm. The switches that bridge the gap and the capacitor may be used in tuning the antenna.

Further features of the invention, its nature and various advantages will be more apparent from the accompanying drawings and the following detailed description of the preferred embodiments.

DETAILED DESCRIPTION

Figure 1:
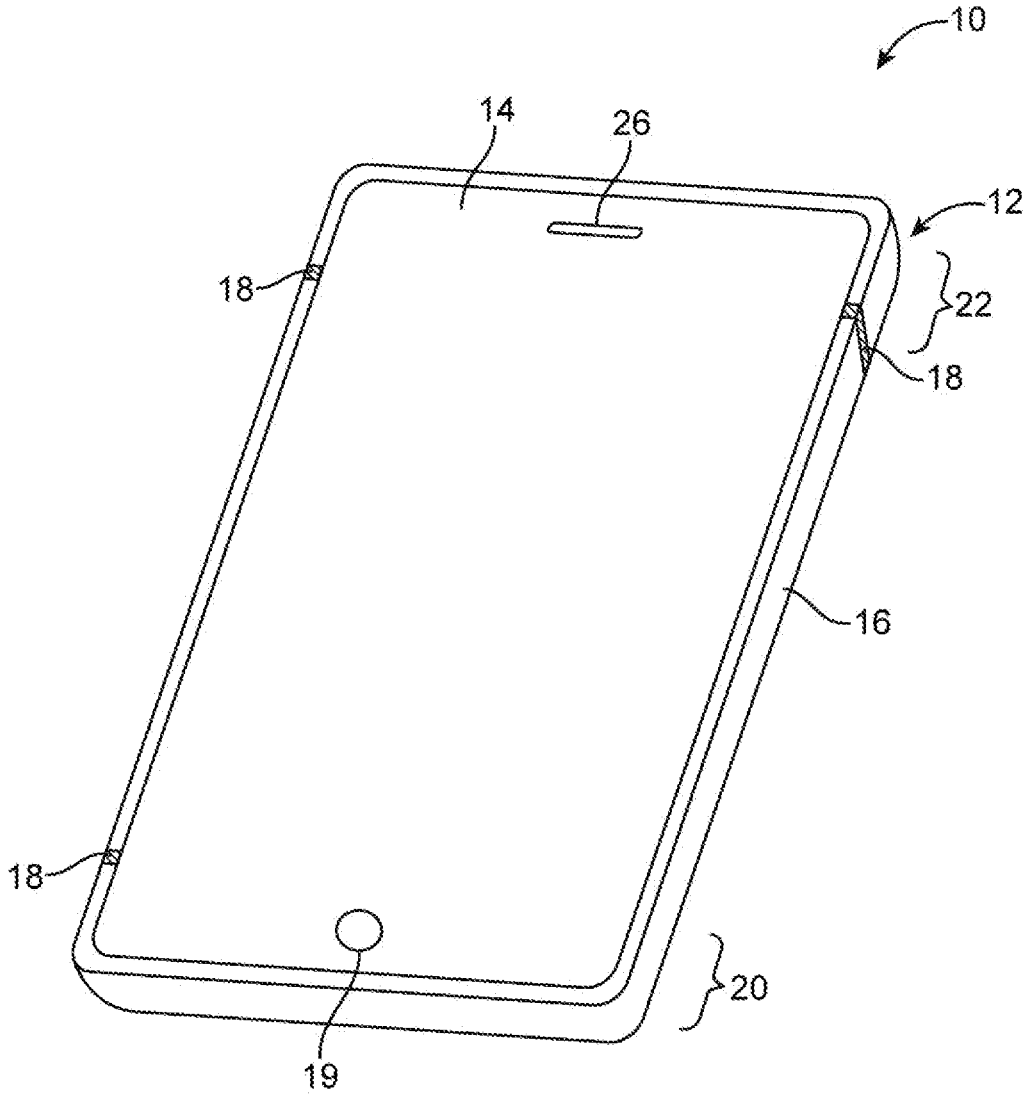
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A cover glass layer may cover the surface of display 14. Buttons such as button 19 may pass through openings in the cover glass. The cover glass may also have other openings such as an opening for speaker port 26.

Housing 12 may include a peripheral member such as member 16. Member 16 may run around the periphery of device 10 and display 14. In configurations in which device 10 and display 14 have a rectangular shape, member 16 may have a rectangular ring shape (as an example). Member 16 or part of member 16 may serve as a bezel for display 14 (e.g., a cosmetic trim that surrounds all four sides of display 14 and/or helps hold display 14 to device 10). Member 16 may also, if desired, form sidewall structures for device 10 (e.g., by forming a metal band with vertical sidewalls, etc.).

Member 16 may be formed of a conductive material and may therefore sometimes be referred to as a peripheral conductive member or conductive housing structures. Member 16 may be formed from a metal such as stainless steel, aluminum, or other suitable materials. One, two, three, or more than three separate structures may be used in forming member 16.

It is not necessary for member 16 to have a uniform cross-section. For example, the top portion of member 16 may, if desired, have an inwardly protruding lip that helps hold display 14 in place. If desired, the bottom portion of member 16 may also have an enlarged lip (e.g., in the plane of the rear surface of device 10). In the example of FIG. 1, member 16 has substantially straight vertical sidewalls. This is merely illustrative. The sidewalls of member 16 may be curved or may have any other suitable shape. In some configurations (e.g., when member 16 serves as a bezel for display 14), member 16 may run around the lip of housing 12 (i.e., member 16 may cover only the edge of housing 12 that surrounds display 14 and not the rear edge of housing 12 of the sidewalls of housing 12).

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular member that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive member 16 and opposing conductive structures such as conductive housing structures, a conductive ground plane associated with a printed circuit board, and conductive electrical components in device 10). These openings may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of member 16 may be provided with gap structures. For example, member 16 may be provided with one or more gaps such as gaps 18, as shown in FIG. 1. The gaps may be filled with dielectric such as polymer, ceramic, glass, air, other dielectric materials, or combinations of these materials. Gaps 18 may divide member 16 into one or more peripheral conductive member segments. There may be, for example, two segments of member 16 (e.g., in an arrangement with two gaps), three segments of member 16 (e.g., in an arrangement with three gaps), four segments of member 16 (e.g., in an arrangement with four gaps, etc.). The segments of peripheral conductive member 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or distinct non-overlapping communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
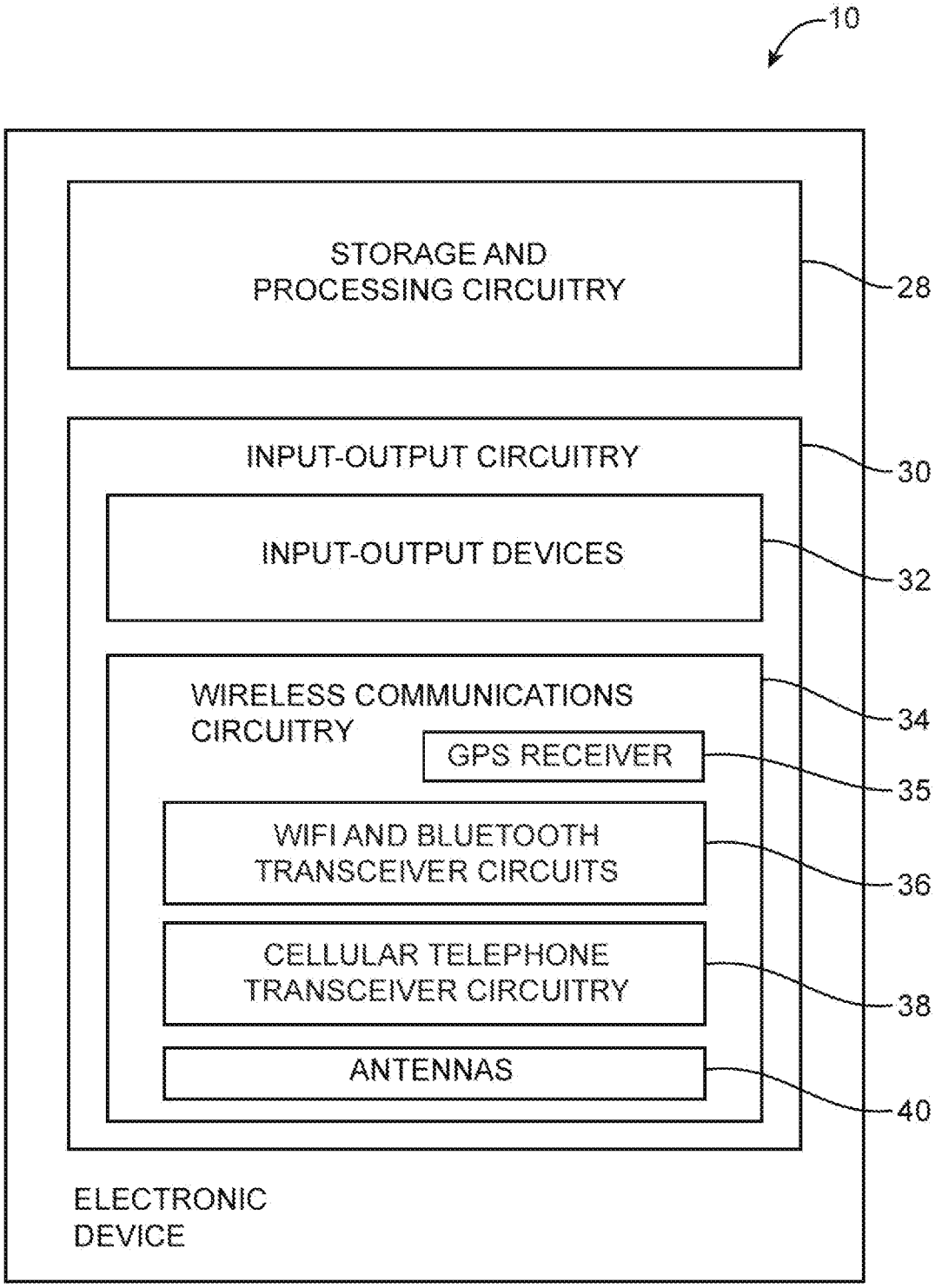
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and/or information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover desired communications bands, etc. In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include global positioning system (GPS) receiver equipment or other satellite navigation system equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from loop antenna structure, patch antenna structures, inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link.

Figure 3:
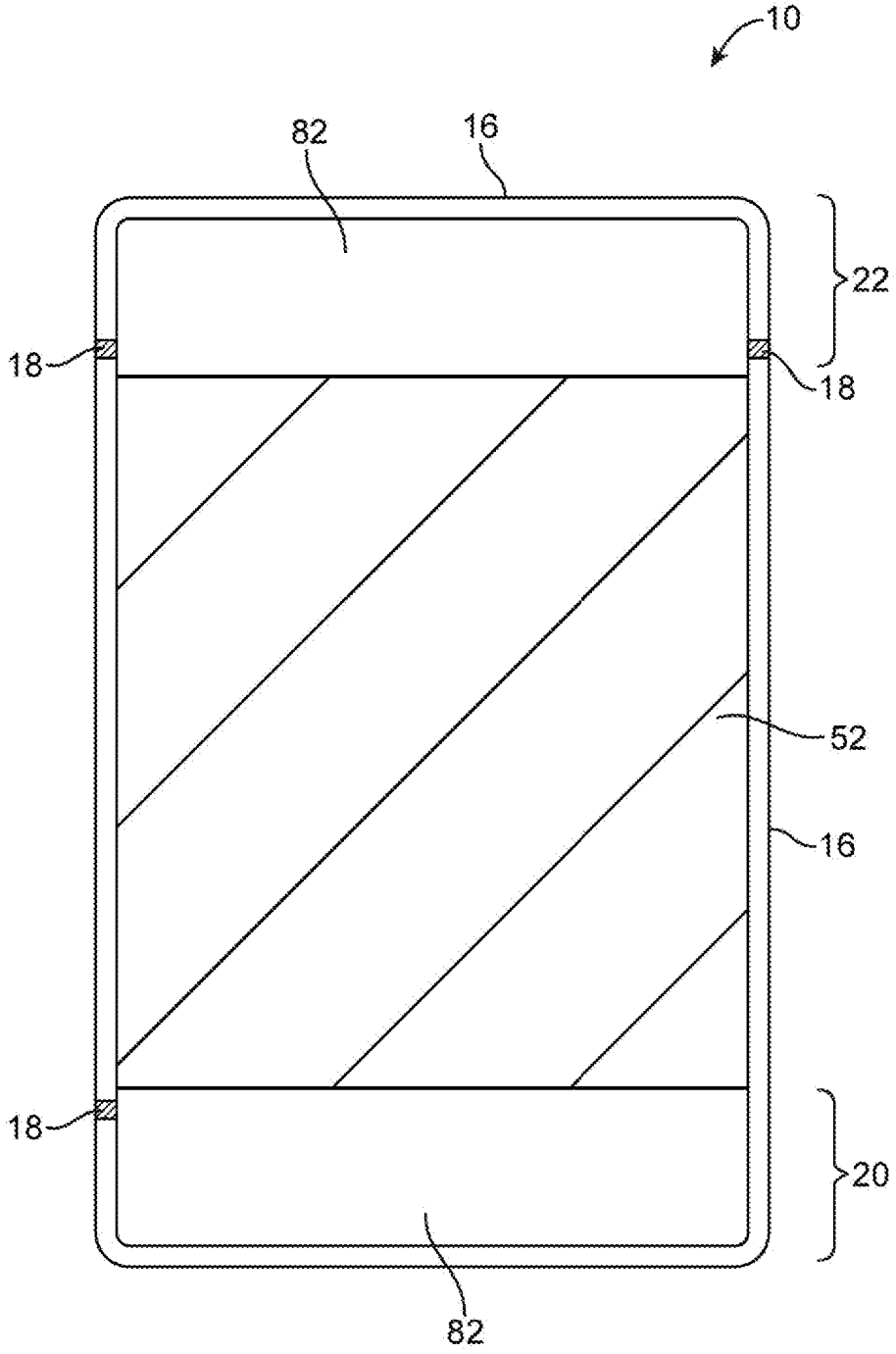
FIG. 3 is a diagram of an illustrative electronic device of the type shown in FIG. 1 showing how structures in the device may form a ground plane and other antenna structures in accordance with an embodiment of the present invention.

A top interior view of device 10 in a configuration in which device 10 has a peripheral conductive housing member such as housing member 16 of FIG. 1 with one or more gaps 18 is shown in FIG. 3. As shown in FIG. 3, device 10 may have an antenna ground plane such as antenna ground plane 52. Ground plane 52 may be formed from traces on printed circuit boards (e.g., rigid printed circuit boards and flexible printed circuit boards), from conductive planar support structures in the interior of device 10, from conductive structures that form exterior parts of housing 12, from conductive structures that are part of one or more electrical components in device 10 (e.g., parts of connectors, switches, cameras, speakers, microphones, displays, buttons, etc.), or other conductive device structures. Gaps such as gaps 82 may be filled with air, plastic, or other dielectric.

One or more segments of peripheral conductive member 16 may serve as part of the conductive structures for an antenna in device 10. For example, the lowermost segment of peripheral conductive member 16 in region 20 may serve as part of the conductive structures for an antenna in device 10. These structures may be provided with switches and other adjustable components or may be provided with fixed components. In arrangements in which an antenna is provided with adjustable components, the antenna may be tuned during operation to cover communications bands of interest. Tunable antennas 40 in device 10 may be implemented using antenna structures in region 22 and/or region 20. Illustrative tunable antenna structures of the type that may be used in region 20 are sometimes described herein as an example.

Figure 4:
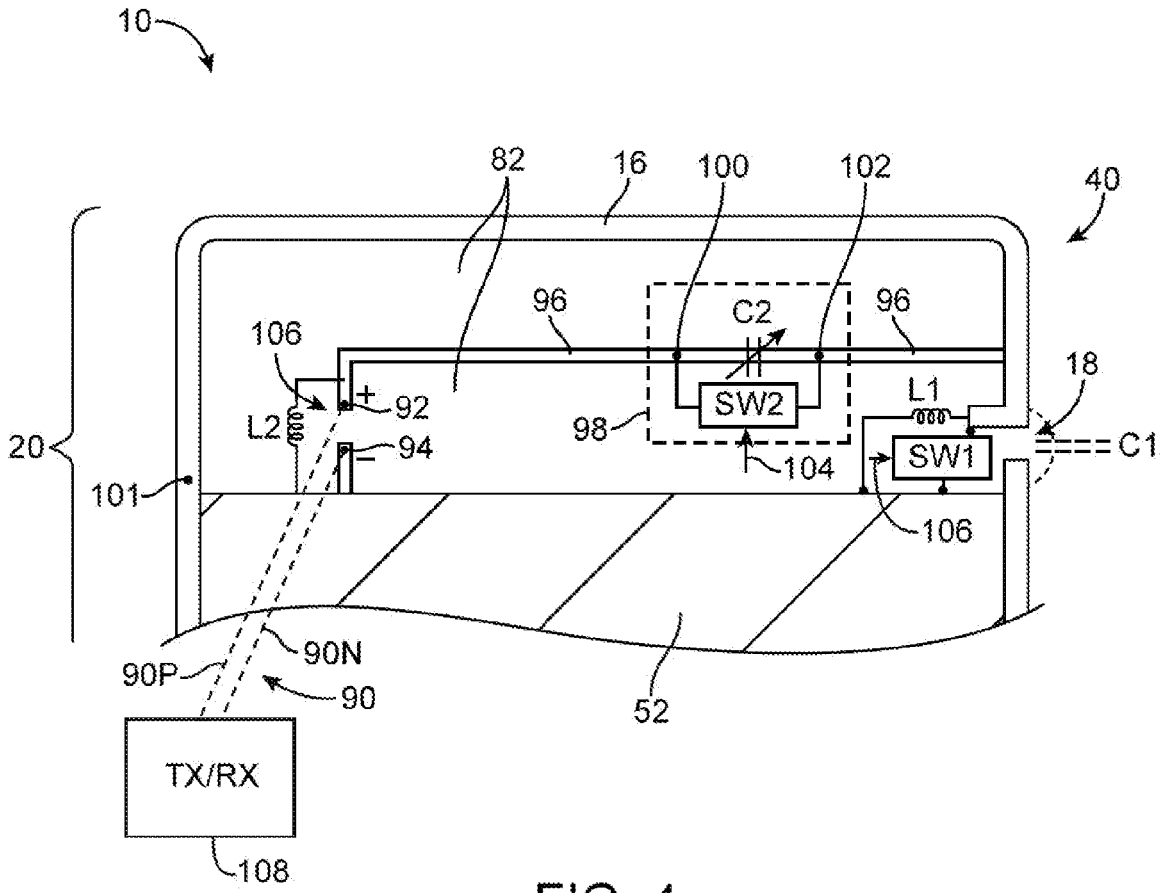
FIG. 4 is diagram of an illustrative tunable antenna in accordance with an embodiment of the present invention.

An illustrative antenna 40 that has been implemented in region 20 of device 10 is shown in FIG. 4. Antenna 40 of FIG. 4 may have an antenna feed such as antenna feed 106. Antenna feed 106 may have a positive antenna feed terminal such as positive antenna feed terminal 92 (+) and a ground antenna feed terminal such as ground antenna feed terminal 94 (−). Wireless circuitry such as radio-frequency transceiver circuitry 108 (e.g., transceiver circuitry such as circuitry 38 of FIG. 2 or other suitable radio-frequency transceiver circuitry) may be coupled to antenna feed 106 using signal paths such as path 90. Path 90 may include one or more transmission lines such as coaxial cable transmission lines, microstrip transmission lines, stripline transmission lines, or other transmission line structures. As shown in FIG. 4, path 90 may include a positive signal conductor such as conductor 90P and a ground signal conductor such as conductor 90N. Impedance matching circuits, filters, switches, and other circuits may be interposed within path 90, if desired.

Conductive structures 52 may form part of antenna (e.g., an antenna ground plane). Antenna 40 may also include conductive structures such as conductive arm 96 and a conductive arm formed from peripheral conductive member 16. Conductive arm 96 may be formed from a strip of metal or other conductive materials. Conductive arm 96 may, for example, be formed from a patterned metal trace on a flexible printed circuit, rigid printed circuit, plastic support structure, or other substrate. Arm 96 may have an L-shape, a shape with two or more straight segments, a shape with curved segments or a combination of curved and straight segments, or other suitable shape. Antenna feed 106 may be coupled between arm 96 and conductive ground plane structures 52. Inductor L2 (e.g., a discrete inductor component such as a surface mount technology component or other inductive element) may be coupled between arm 96 and ground plane structures 52 at a first end of arm 96. Another inductor such as inductor L1 may be coupled to an opposing second end of arm 96.

A circuit such as tunable circuit 98 may be interposed in arm 96. Circuit 98 may include one or more adjustable components that may be used in tuning antenna 40. As shown in FIG. 4, for example, circuit 98 may include a capacitor such as capacitor C2 (e.g., a tunable capacitor or a fixed capacitor) and a bypass switch such as switch SW2. Circuit 98 may have a first terminal such as terminal 100 and a second terminal such as terminal 102. Capacitor C2 and switch SW2 may be coupled in parallel between terminals 100 and 102. The state of switch SW2 may be controlled by control signals from control circuitry in device 10 such as storage and processing circuitry 28 (e.g., a baseband processor). Switch control signals may be provided to switch SW2 over a control signal path such as path 104. When switch SW2 is open, capacitance C2 (e.g., a fixed or variable capacitance) may be interposed in arm 96. When switch SW2 is closed, capacitance C2 may be bypassed. Other types of adjustable capacitance circuitry may be interposed in arm 96 if desired. The example of FIG. 4 is merely illustrative.

Peripheral conductive member 16 may form a conductive path (arm) that is shorted to antenna ground 52 at one end (e.g., on the left-hand side of gap 82 at location 101) and that is separated from ground 52 (e.g., portions of member 16 that are shorted to ground 52) at another end (e.g., at gap 18). Gap 18 may give rise to a parasitic capacitance C1 between the end of arm 96 and ground structure 52.

An antenna tuning circuit such as a circuit formed from inductor L1 and switch SW1 may bridge gap 18. The state of switch SW1 may be controlled by control signals from control circuitry in device 10 such as storage and processing circuitry 28 (e.g., a baseband processor). Switch control signals may be provided to switch SW1 over a control signal path such as path 106. When switch SW1 is open, inductor L1 may be coupled across gap 18 in parallel with parasitic capacitance C1. When switch SW1 is closed, inductor L1 and capacitance C1 may be bypassed by the short circuit formed by switch SW1 (i.e., gap 18 may be temporarily bridged by the short circuit formed by switch SW1).

Antenna tuning adjustments may be made to antenna 40 to configure antenna 40 to cover desired operating frequencies. The frequency response of antenna 40 may be tuned by adjusting adjustable components in antenna 40 such as capacitor C2, switch SW2, and switch SW1. If desired, additional adjustable circuitry may be used (e.g., adjustable matching circuits, additional switches in antenna 40, etc.).

Figure 5:
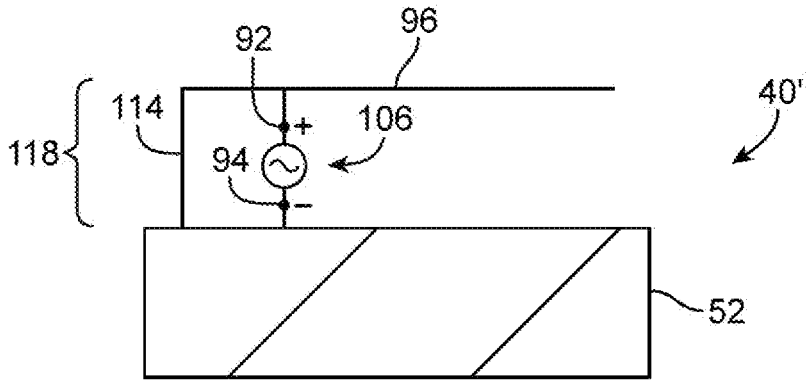
FIG. 5 is a diagram of an illustrative inverted-F antenna structure for an antenna in accordance with an embodiment of the present invention.

The way in which antenna 40 of FIG. 4 operates may be understood with reference to FIGS. 5-14, which show how antenna 40 of FIG. 4 may be constructed by adding progressively more components to an inverted-F antenna (i.e., antenna 40' of FIG. 5).

As shown in FIG. 5, antenna 40' may have an antenna resonating element such as antenna resonating element 118 and a ground structure such as ground 52. Antenna resonating element 118 may have a main resonating element arm such as arm 96. Short circuit branch 114 may couple arm 96 to ground 52. Antenna feed 106 may contain positive antenna feed terminal 92 (+) and ground antenna feed terminal 94 (−). Antenna feed 106 may be formed using a branch of antenna resonating element 118 that couples arm 96 to ground 52.

Figure 6:
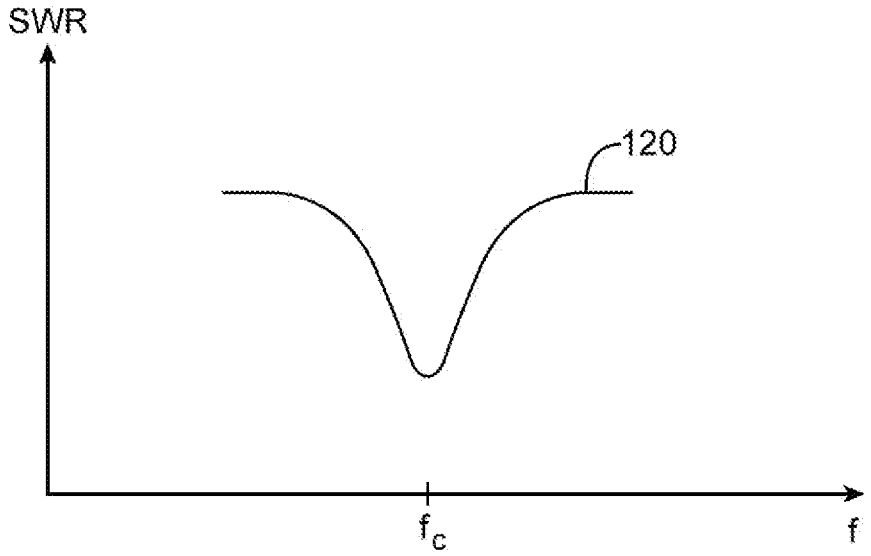
FIG. 6 is a graph of antenna performance associated with use of the antenna structure of FIG. 5 in accordance with an embodiment of the present invention.

FIG. 6 is a graph of antenna performance (standing wave ratio) as a function of operating frequency for an antenna such as inverted-F antenna 40' of FIG. 5. As shown by curve 120 of FIG. 6, antenna 40' of FIG. 5 may exhibit a resonance in a communications band centered on frequency fc. During operation, signals in this communications band may be transmitted and received using antenna 40'.

Figure 7:
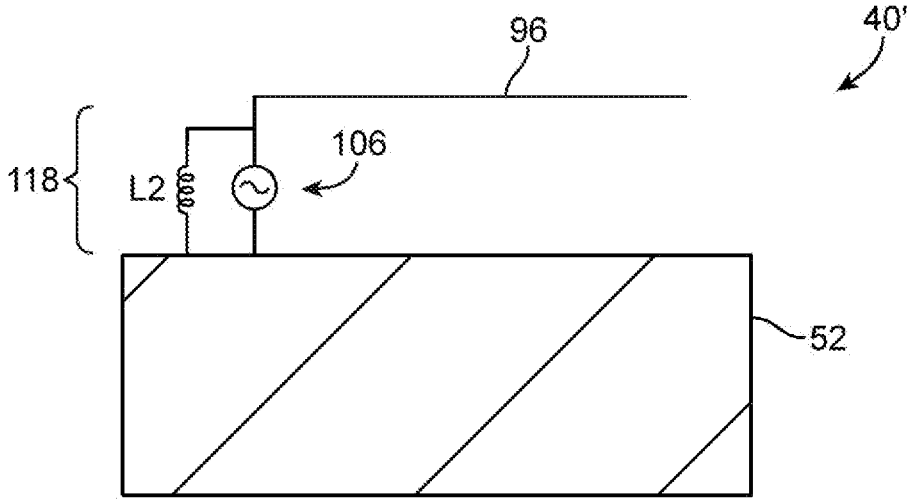
FIG. 7 is a diagram of illustrative inverted-F antenna structures with an inductor path in parallel with an antenna feed for an antenna in accordance with an embodiment of the present invention.

If desired, short circuit branch 114 of antenna resonating element 118 in antenna 40' may be implemented using a discrete component such as a surface mount technology (SMT) inductor or other inductor. This type of configuration for antenna 40' is shown in FIG. 7. As shown in FIG. 7, inductor L2 may be coupled between arm 96 and ground 52 in place of short circuit branch 114 of FIG. 5 (e.g., at the leftmost end of arm 96 in the orientation of FIG. 7). Branch 114 of FIG. 5 may be characterized by a finite inductance. The resulting frequency response of antenna 40' when inductor L2 of FIG. 7 is used in place of short circuit branch 114 of FIG. 5 may therefore still be characterized by a curve such as curve 120 of FIG. 6.

Figure 8:
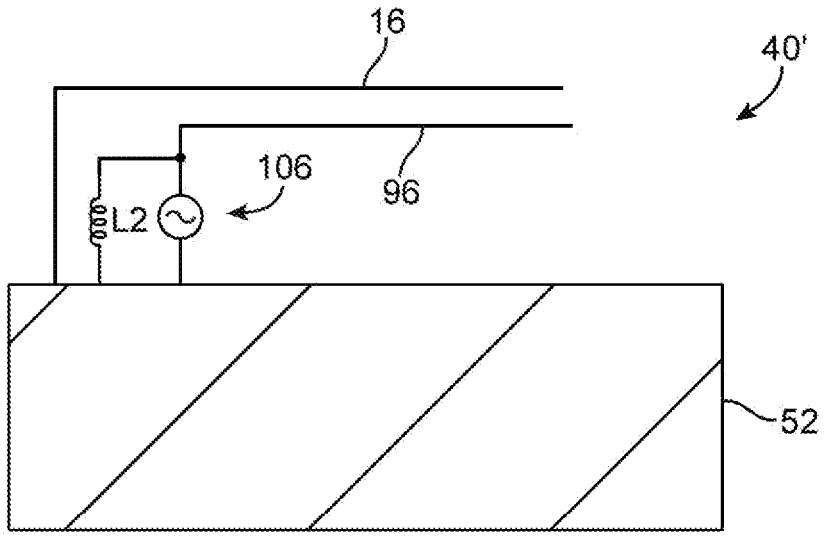
FIG. 8 is a diagram of illustrative antenna structures with an inductor path in parallel with an antenna feed and an L-shaped parasitic antenna resonating element for an antenna in accordance with an embodiment of the present invention.

If desired, antenna 40' may be provided with a parasitic antenna resonating element such as L-shaped parasitic antenna resonating element 16 of FIG. 8 (e.g., a portion of peripheral conductive member 16 of FIG. 4). Parasitic antenna resonating element 16 may, for example, have an arm that runs parallel to arm 96. The lengths of the L-shaped parasitic antenna resonating element arm and the inverted-F antenna resonating element arm in antenna 40' may be different. For example, parasitic antenna resonating element arm 16 may be longer than arm 96. This may help to broaden the frequency response of antenna 40'.

Figure 9:
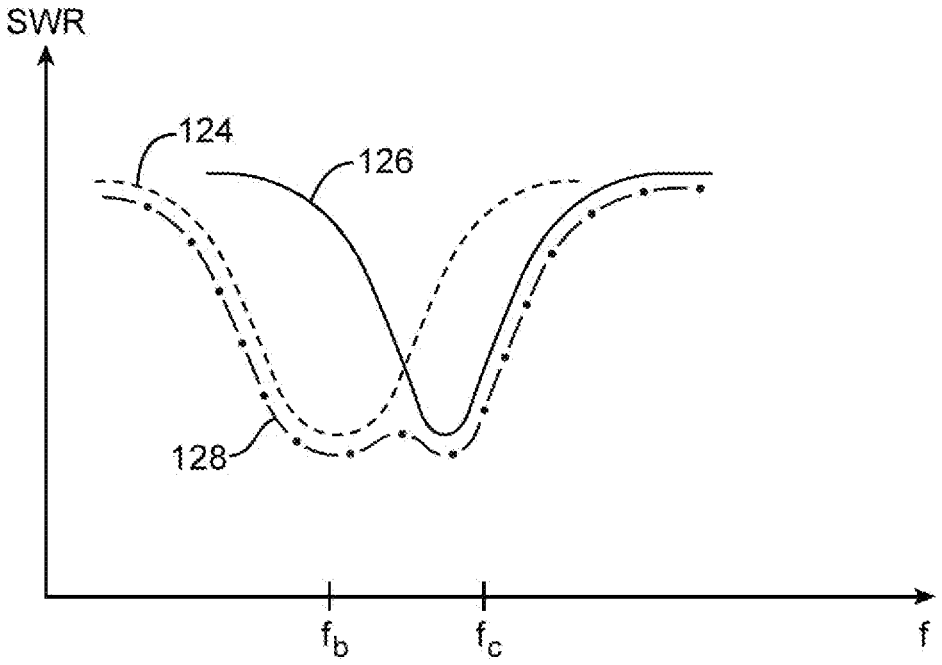
FIG. 9 is a graph of antenna performance associated with use of the antenna structures of FIG. 8 in accordance with an embodiment of the present invention.

FIG. 9 is a graph of antenna performance (standing wave ratio) as a function of operating frequency for an antenna such as inverted-F antenna 40' of FIG. 8. Parasitic antenna resonating element 16 may be characterized by a resonance such as the resonance of curve 124, centered at frequency fb. In the absence of parasitic antenna resonating element 16, antenna 40' (i.e., antenna resonating element arm 96) may be characterized by curve 126, which exhibits a resonance centered at frequency fc. When inverted-F antenna resonating element arm 96 and parasitic antenna resonating element 16 are both present, as in FIG. 8, antenna 40' may exhibit a response of the type shown by curve 128. Because curve 128 is influenced by both the shorter antenna arm (resonating element arm 96) and the longer antenna arm (parasitic antenna resonating element arm 16), the resonance of curve 128 may be broader than the resonance of curve 120 of FIG. 6.

Figure 10:
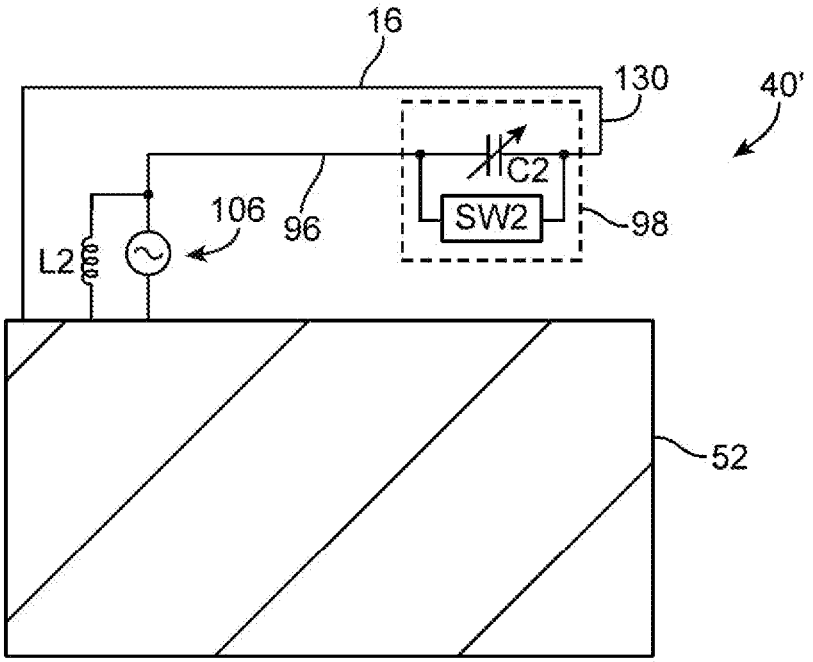
FIG. 10 is a diagram of illustrative antenna structures of the type shown in FIG. 8 that have been provided with a bypassable capacitor circuit for performing antenna tuning functions in accordance with an embodiment of the present invention.

As shown in FIG. 10, antenna 40' may be provided with a tunable circuit such as tunable circuit 98 in arm 96 and may have conductive structures such as conductive path 130 that couples antenna resonating element arm 96 to arm 16. Circuit 98 may include a capacitor such as capacitor C2. Capacitor C2 may be a fixed capacitor or may be a variable capacitor. Switch SW2 may be used to selectively bypass capacitor C2. Circuit 98 may be formed using one or more components. For example, capacitor C2 and switch SW2 may be formed using individual components or may be formed using a single unitary part.

Figure 11:
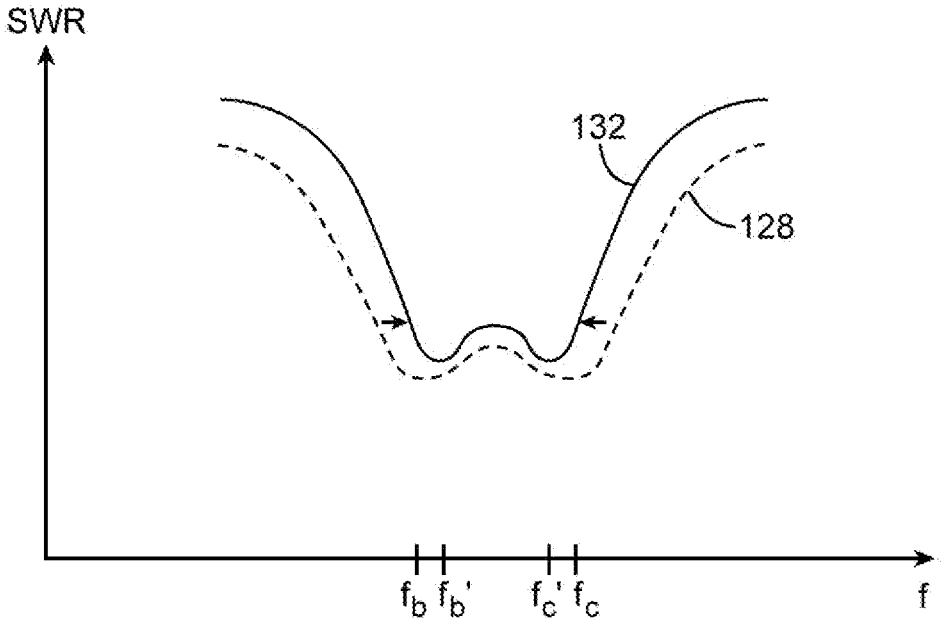
FIG. 11 is a graph of antenna performance associated with use of the antenna structures of FIG. 10 in accordance with an embodiment of the present invention.

FIG. 11 is a graph of antenna performance (standing wave ratio) as a function of operating frequency for an antenna such as antenna 40' of FIG. 10. In the absence of capacitor C2, antenna 40' may be characterized by curve 128 (i.e., curve 128 of FIG. 9). When capacitance C2 is present, however, antenna 40' may be characterized by narrower curve 132. If, for example, curve 128 is characterized by frequency resonance peaks fb (from element 16) and fc (from element 96), curve 132 may be characterized by frequency response peaks at frequency fb' (i.e., a frequency greater than fb) and at frequency fc' (i.e., a frequency less than fc). Capacitance C2 may be switched into use (e.g., by opening switch SW2) to ensure that the response of antenna 40' matches a desired communications band of interest (e.g., so that antenna 40' exhibits the narrower resonance of curve 132 of FIG. 11). In configurations in which capacitance C2 is variable, the magnitude of capacitance C2 may be adjusted to adjust the width of curve 132.

Figure 12:
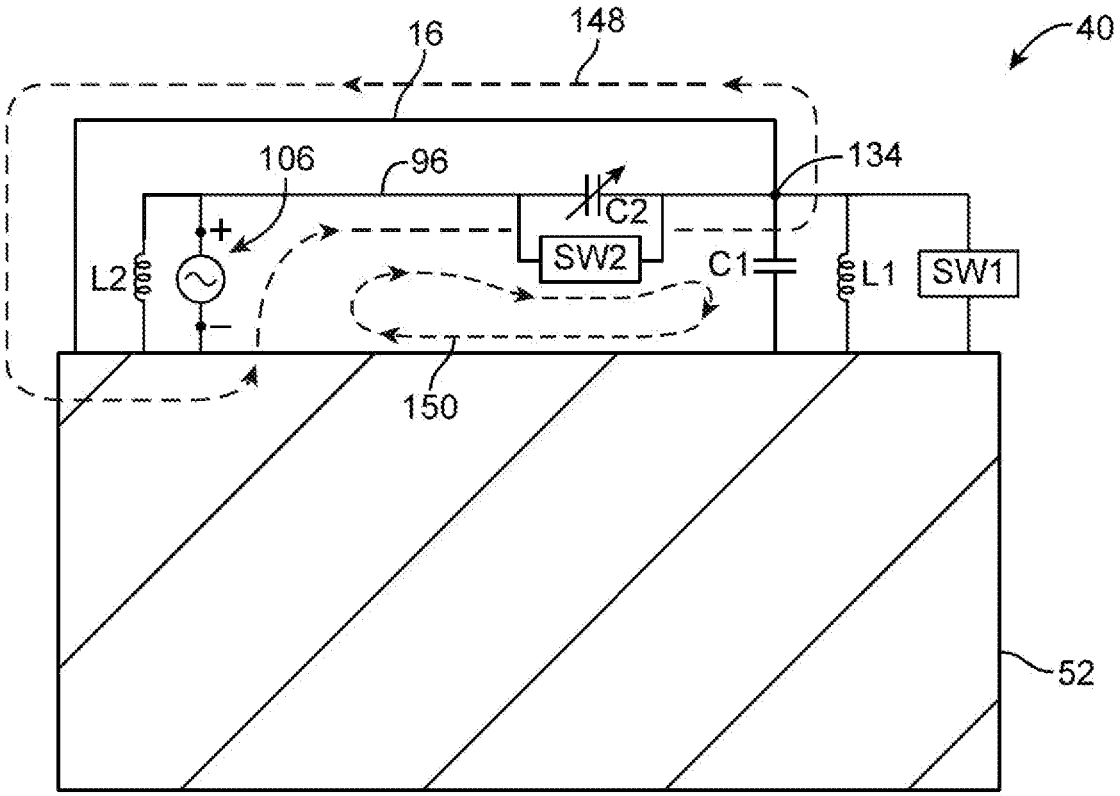
FIG. 12 is a diagram of illustrative antenna structures of the type shown in FIG. 10 that have been provided with a tuning circuit such as a switch-based tuning circuit to form an antenna of the type shown in FIG. 4 in accordance with an embodiment of the present invention.

As shown in FIG. 12, when capacitor C1 (e.g., a parasitic capacitance associated with gap 18 of FIG. 4), inductor L1, and switch SW1 are coupled between tip 132 of arm 96 (and/or an associated portion of arm 16) and ground (e.g., across gap 18 of FIG. 4), antenna 40' of FIG. 10 may have the configuration of antenna 40 of FIG. 4 (i.e., antenna 40 of FIG. 12 may be implemented using structures of the type shown in FIG. 4). If desired, antenna 40 of FIG. 12 may be implemented using other structures. The antenna structures and circuitry of FIG. 4 are merely an illustrative example of structures and circuits that can be used in implementing antenna 40 of FIG. 12.

Figure 13:
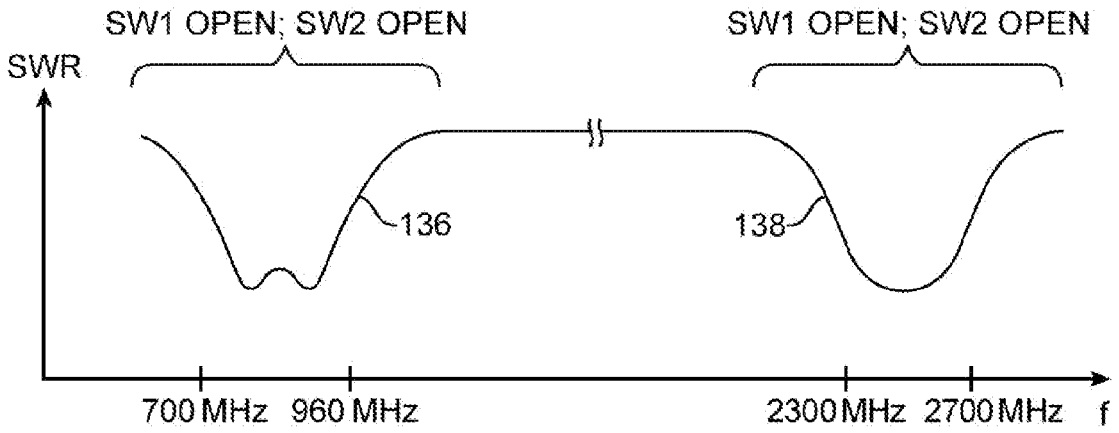
FIGS. 13 and 14 are graphs of antenna performance associated with use of the antenna of FIG. 12 in accordance with an embodiment of the present invention.
Figure 14:
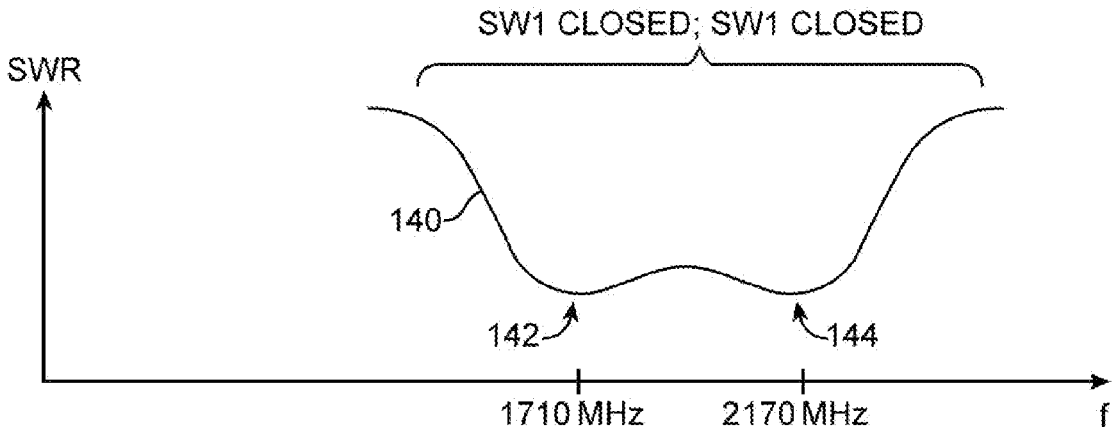

FIGS. 13 and 14 are graphs showing how antenna 40 of FIG. 12 may perform as a function of operating frequency and how antenna 40 may be tuned by controlling the states of switches SW1 and SW2. FIG. 13 is a graph of antenna performance (standing wave ratio) as a function of operating frequency for an antenna such as antenna 40 of FIG. 12 in a configuration in which switches SW1 and SW2 are both open. Operating frequencies from about 700-960 MHz may correspond to a "low" communications band for antenna 40 (as an example). In this low band, inductor L1 and capacitance C1 may form a resonant circuit with a relatively large impedance (i.e., inductor L1 and C1 may form an open circuit at frequencies in the range of 700-960 MHz). Because the circuit formed by L1 and C1 is effectively open and because switch SW1 is open, the shape of low band curve portion 136 of FIG. 13 may match that of curve 132 in FIG. 11 (the shape of which may be tuned by adjusting capacitance C2 in configurations for antenna 40 in which capacitor C2 is a variable capacitor). At higher frequencies (e.g., frequencies in the vicinity of 2300 MHz to 2700 MHz or other suitable frequency range), antenna 40 of FIG. 12 may exhibit a resonant peak such as resonant peak 138 (i.e., antenna 40 may exhibit performance satisfactory for handling communications at frequencies from 2300 MHz to 2700 MHz while switches SW1 and SW2 are open).

When it is desired to cover lower high-band frequencies such as frequencies from 1710 MHz to 2170 MHz (or other suitable frequency range), control circuitry in device 10 may be used to close switches SW1 and SW2. In this configuration, antenna 40 of FIG. 12 may exhibit a response of the type shown by curve 140 of FIG. 14. The response of curve 140 may be influenced by contributions from two different loop antenna modes in antenna 40 of FIG. 12. As shown in FIG. 12, antenna 40 may, have a first (longer) loop antenna mode associated with loop-shaped signal path 148 and may have a second (shorter) loop antenna mode associated with loop-shaped signal path 150 of FIG. 12. The shorter loop antenna mode may give rise to resonant contribution 144 of curve 140 of FIG. 14. The longer loop antenna mode may give rise to resonant contribution 142 of curve 140 of FIG. 14.

Figure 15:
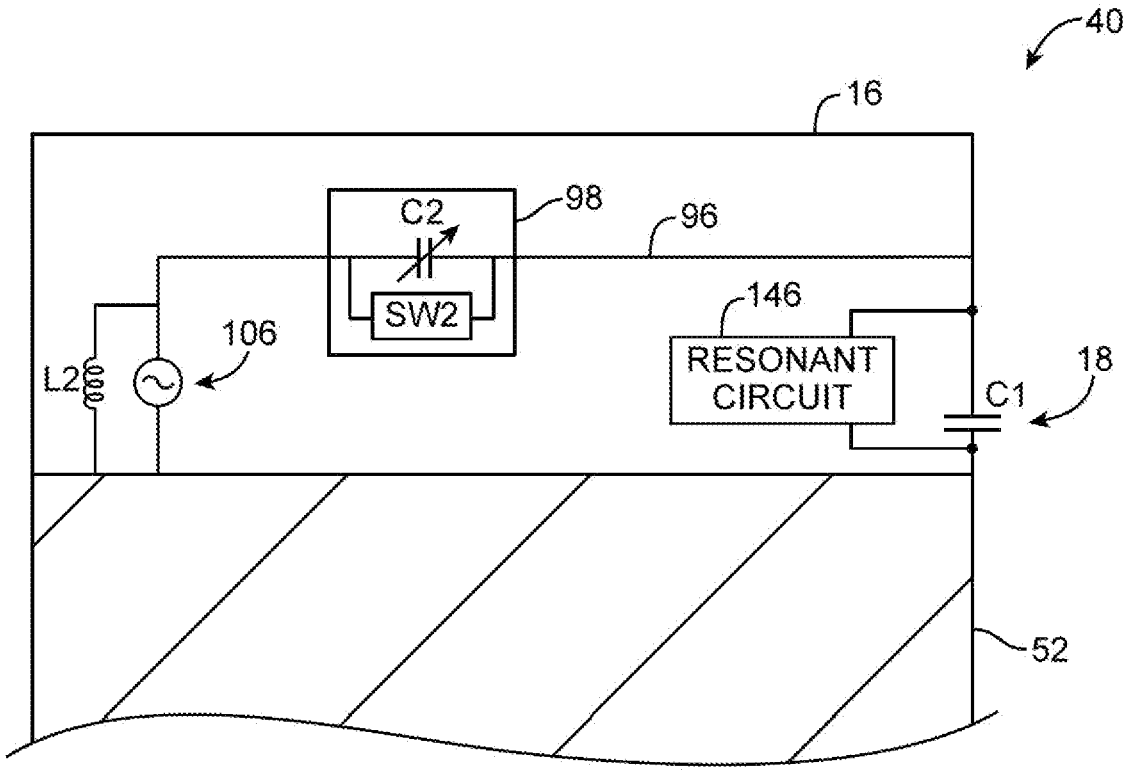
FIG. 15 is a diagram of illustrative antenna structures of the type shown in FIG. 12 in which the switch-based tuning circuitry of FIG. 12 had been replaced with a passive resonant-circuit in accordance with an embodiment of the present invention.

In the illustrative configuration of FIG. 12, antenna 40 has actively adjusted components such as switches SW1 and SW2 for ensuring that antenna 40 exhibits a desired response as a function of frequency. If desired, passive switching techniques may be used to perform switching in antenna 40. For example, an arrangement of the type shown in FIG. 15 may be used for antenna 40 in which switch SW1 is replaced by resonant circuit 146. Resonant circuit 146 and capacitor C1 may be configured to form a resonant circuit with an impedance that changes as a function of frequency. Circuit 146 may be configured so that a short circuit is formed across gap 18 at frequencies from 1710 MHz to 2170 MHz (or other suitable frequency range) and to form a high impedance (e.g., an open circuit) at other frequencies (e.g., the low band and/or the high band of FIG. 13). When configured in this way, circuit 146 can form a short circuit of the type formed by closed switch SW2 of FIG. 12 during operation at 1710 MHz to 2170 MHz (e.g., to produce curve 140 of FIG. 14) and can form an open circuit at other frequencies such as the frequencies associated with the low band (700-960 MHz) and high band (2300-2700 MHz) (e.g., to produce curves 136 and 138 of FIG. 13).

The foregoing is merely illustrative of the principles of this invention and various modifications can be made by those skilled in the art without departing from the scope and spirit of the invention.

What is claimed is:

1. An antenna, comprising:

a ground plane;

a first arm that has opposing first and second ends, that includes first and second segments, and that is electrically coupled to the ground plane;

an antenna feed coupled between the ground plane and the second end of the first arm;

a tunable circuit interposed in the first arm between the first and second segments;

a second arm having a first end that is directly connected to the first end of the first arm and having a second end that is coupled to the ground plane; and an inductor that electrically couples the second end of the first arm to the ground plane.

2. The antenna defined in claim 1 further comprising a switch that is coupled between the end of the first arm and the ground plane.

3. The antenna defined in claim 1 wherein the tunable circuit comprises a variable capacitor.

4. The antenna defined in claim 1 wherein the tunable circuit comprises a capacitor.

5. The antenna defined in claim 1 wherein the tunable circuit comprises a switch and a capacitor in parallel with the switch.

6. The antenna defined in claim 1 wherein the tunable circuit comprises a first switch and a capacitor in parallel with the first switch, the antenna further comprising a switch that is coupled between the end of the first arm and the ground plane.

7. The antenna defined in claim 1 wherein the second arm comprises at least part of a peripheral conductive member that runs around at least some edges of a housing for an electronic device.

8. The antenna defined in claim 7 further comprising a gap in the peripheral conductive member, wherein the antenna further comprises an inductor that bridges the gap.

9. The antenna defined in claim 8 further comprising a switch that bridges the gap.

10. The antenna defined in claim 8 further comprising a first switch that bridges the gap, wherein the tunable circuit comprises a second switch and a capacitor in parallel with the second switch.

11. An antenna, comprising:

an antenna ground;

a resonating element arm having opposing first and second ends;

an antenna feed coupled between the antenna ground and the resonating element arm;

a first inductor that is coupled between the resonating element arm and the antenna ground at the first end;

a peripheral conductive member that runs around at least some edges of a conductive housing for an electronic device, wherein portions of the peripheral conductive member are separated from the antenna ground by first and second gaps that create respective parasitic capacitances between the peripheral conductive member and the antenna ground and that divide the peripheral conductive member into at least three segments; and a second inductor that is coupled between the peripheral conductive member and the antenna ground and that bridges the second gap.

12. The antenna defined in claim 11 further comprising a switch that is coupled in parallel with the second inductor.

13. The antenna defined in claim 11 further comprising a switch that is coupled in parallel with the second inductor and the second gap.

14. The antenna defined in claim 13 wherein the peripheral conductive member has a first portion that is electrically connected to the antenna ground and a second portion that is separated from the antenna ground by the second gap, and the second end of the antenna resonating element arm is coupled to the second portion of the peripheral conductive member.

15. The antenna defined in claim 11 further comprising a tunable circuit that is interposed in the antenna resonating element arm.

16. The antenna defined in claim 15 wherein the tunable circuit includes a capacitor.

17. An antenna, comprising:

an antenna ground;

a peripheral conductive member that runs around at least two external edges of a housing for an electronic device;

a resonating element arm having a first end that is coupled to the antenna ground and a second end that is coupled to the peripheral conductive member;

an antenna feed coupled between the ground plane and the resonating element arm; and a switch that is coupled between the peripheral conductive member and the antenna ground.

18. The antenna defined in claim 17 wherein the peripheral conductive member is separated from the antenna ground by at least one gap that creates a parasitic capacitance between the peripheral conductive member and the antenna ground and wherein the switch bridges the gap.

19. The antenna defined in claim 18 further comprising a capacitor interposed in the antenna resonating element arm.

20. The antenna defined in claim 19 further comprising an additional switch that bridges the capacitor.

21. The antenna defined in claim 20 further comprising:

an inductor coupled in parallel with the switch.

22. The antenna defined in claim 1, wherein the tunable circuit is interposed in the first arm at a location between the antenna feed and where the first end of the first arm and the first end of the second arm are directly connected.

23. The antenna defined in claim 17, wherein the peripheral conductive member has portions that are separated from the antenna ground by first and second gaps that create respective parasitic capacitances between the peripheral conductive member and the antenna ground and divide the peripheral conductive member into at least three segments.

* * * * *